US006741717B2

(12) United States Patent
Dedieu et al.

(10) Patent No.: US 6,741,717 B2
(45) Date of Patent: May 25, 2004

(54) DEVICE FOR REDUCING STRUCTURAL-ACOUSTIC COUPLING BETWEEN THE DIAPHRAGM VIBRATION FIELD AND THE ENCLOSURE ACOUSTIC MODES

(75) Inventors: Stephane Dedieu, Ottawa (CA); Philippe Moquin, Kanata (CA)

(73) Assignee: Mitel Knowledge Corporation, Ottawa (CA)

( * ) Notice: Subject to any disclaimer, the term of this patent is extended or adjusted under 35 U.S.C. 154(b) by 0 days.

(21) Appl. No.: 10/256,569

(22) Filed: Sep. 26, 2002

(65) Prior Publication Data

US 2003/0063767 A1 Apr. 3, 2003

(30) Foreign Application Priority Data

Sep. 28, 2001 (GB) ..... 0123451

(51) Int. Cl.[7] ..... H04R 1/22
(52) U.S. Cl. ..... 381/345; 381/348
(58) Field of Search ..... 381/86, 87, 153, 381/160, 190, 332, 335, 345, 348, 350, 351, 352, 353, 386, 389; 181/150, 199; 455/569.1; 379/433.01, 433.02, 433.03, 434, 440

(56) References Cited

U.S. PATENT DOCUMENTS 5,953,414 A * 9/1999 Abraham et al. ..... 381/190
5,996,727 A * 12/1999 Blind et al. ..... 181/150

FOREIGN PATENT DOCUMENTS

| | | |
|---|---|---|
| CA | 2314862 | 2/2001 |
| DE | 41 17 598 A1 | 12/1992 |
| EP | 0909 077 A2 | 4/1999 |
| GB | 2 333 004 A | 7/1999 |
| GB | 0123451.7 | 5/2002 |

* cited by examiner

*Primary Examiner*—Curtis Kuntz
*Assistant Examiner*—Brian Ensey
(74) *Attorney, Agent, or Firm*—Marger Johnson & McCollom, P.C.

(57) ABSTRACT

A novel cap for a telephone unit is provided to de-couple the loudspeaker diaphragm from the acoustic resonance in the enclosure and dampen the first resonant frequency of the diaphragm. The cap has a flange located at an outer edge thereof and a cavity provided in the cap. The cap cavity is sized to house an acoustical speaker that is directed outwardly through an aperture in an outer casing of the telephone unit. The flange of the cap is coupled to the outer casing so that the cap covers the aperture. A gap is provided between the cap and the outer casing.

10 Claims, 7 Drawing Sheets

DEVICE FOR REDUCING STRUCTURAL-ACOUSTIC COUPLING BETWEEN THE DIAPHRAGM VIBRATION FIELD AND THE ENCLOSURE ACOUSTIC MODES

FIELD OF THE INVENTION

The present invention relates to a device for reducing the structural-acoustic coupling between the diaphragm vibration field and the enclosure acoustic modes in a small speaker. In particular, the present invention relates to a modified acoustic cap.

BACKGROUND OF THE INVENTION

In systems having small speakers, such as telephone sets, cost is an important issue. Small, inexpensive loudspeakers having a size of 50 to 60 mm are typically used. In order to produce enough sound power given the mass of the diaphragm, both the stiffness of the cone edge and the damping tend to be low. Therefore, the diaphragm has a high mobility.

Due to the dimensions of the telephone sets or small speakers, acoustic resonances can occur in the enclosure in the frequency band of interest, 300–3400 Hz for traditional telephony, and 150–7000 Hz for wide-band telephony. The coupling of the loudspeaker diaphragm with the acoustic modes (resonances) in the enclosure produces unwanted effects on the global sound receive curve in the frequency band of interest. This coupling results in notches that have an amplitude which depends on the loudspeaker diaphragm damping, diaphragm stiffness and on its position relative to the enclosure acoustic modeshapes.

For cost and manufacturing reasons it is typically undesirable to use acoustic damping, such as foam or a similar material, in the enclosure to limit acoustic resonances.

The inventors are unaware of any devices that have been designed that provide an alternative to the use of an enclosure treatment: U.S. Pat. No. 5,150,418 to Honda et al. discloses a cap having a bass-reflex, which attempts to widen the loudspeaker frequency response. U.S. Pat. No. 4,618,025 to Sherman discloses a cap provided in a speaker enclosure that attempts to dampen the diaphragm and lower its first resonance frequency. The prior art does not contemplate controlling the coupling between the loudspeaker diaphragm and acoustic modes in the enclosure in order to modify the acoustic response.

It is therefore an object of an aspect of the present invention to provide a device that can be used to control the coupling between the loudspeaker diaphragm and acoustic modes in the enclosure in order to modify the global sound receive curve in the frequency band of interest.

SUMMARY OF THE INVENTION

According to one aspect of the present invention there is provided a housing for an acoustical speaker having a movable diaphragm. The housing comprises an outer casing having an aperture, a cap having a flange located at an outer edge thereof, the flange being coupled to the outer casing so that the cap covers the aperture, and a cavity provided in the cap, the cavity being sized to house the acoustical speaker. The cap de-couples the diaphragm from the acoustic resonances in the outer casing. A gap is provided between the cap and the outer casing which dampens a first resonant frequency of the diaphragm without strong coupling to the acoustic resonances.

Preferably, the flange of the cap comprises at least one protrusion extending from the flange for abutting the outer casing, wherein the gap is provided between the flange and the outer casing delimited by the protrusion.

It is an advantage of an aspect of the present invention that the coupling between the loudspeaker diaphragm and acoustic modes in the enclosure is controlled thus, the acoustic response can be controlled.

It is a further advantage of an aspect of the present invention that the diaphragm resonance peaks, primarily the first one, are dampened, which widens the speaker sound response in the low frequency end.

BRIEF DESCRIPTION OF THE DRAWINGS

An embodiment of the present invention will now be described more fully with reference to the accompanying drawings in which.

DETAILED DESCRIPTION OF THE PREFERRED EMBODIMENT

Any closed or partially open enclosure, such as a telephone or speaker housing that is perfectly or partially closed (ie. leaks are possible), exhibits acoustic resonance as a result of acoustic pressure standing waves in the enclosure. Resonant frequencies, also named eigen-frequencies or natural frequencies, are associated with these acoustic resonances. The shape of the standing waves, called modeshapes, modes or eigenmodes, depends on the geometry of the enclosure. The frequency of the standing waves is related to the enclosure dimensions.

Acoustic eigen-frequencies and eigen-modes of a closed rectangular enclosure with rigid walls, dimensions Lx, Ly, Lz are calculated using the following equations:

$$Eigenfrequencies: F_{mnp} = \frac{c}{2\pi}\sqrt{\left(\frac{m\pi}{L_x}\right)^2 + \left(\frac{n\pi}{L_x}\right)^2 + \left(\frac{p\pi}{L_x}\right)^2}$$

$$m = 0, 1, 2, \ldots$$
$$n = 0, 1, 2, \ldots$$
$$p = 0, 1, 2, \ldots$$

$$Eigenmodes: \Psi_{mnp} = A_{mnp}\mathrm{Cos}\left(\frac{m\pi}{L_x}x\right)\mathrm{Cos}\left(\frac{n\pi}{L_y}x\right)\mathrm{Cos}\left(\frac{p\pi}{L_z}z\right)$$

where c is the sound speed and $A_{mnp}$ is a set of coefficients resulting from the normalization of each eigenmode amplitude.

Figure 1:
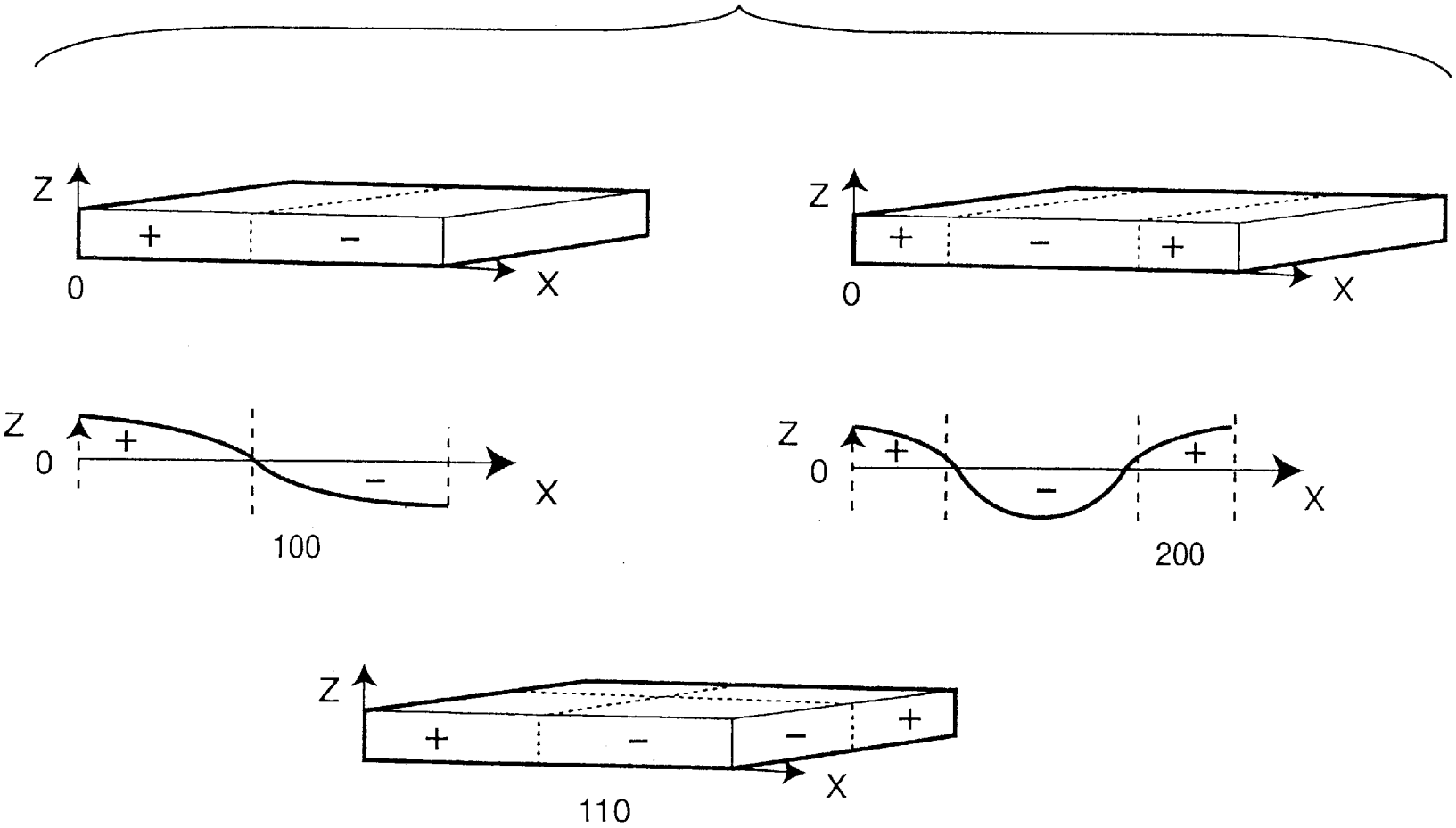
FIG. 1 illustrates some acoustic modeshapes or eigenmodes of a rectangular box with rigid walls.

Referring to FIG. 1, some acoustic modeshapes, or eigenmodes, of a rectangular box with rigid walls are shown. The acoustic modes and natural frequencies of cavities with more complex geometries can be determined using Finite or/and Boundary Element analysis.

At each frequency f, a pressure field P(f) generated in the enclosure by any kind of source, such as an acoustic transducer or loudspeaker diaphragm, is a linear combination of the acoustic modes $\Psi_i$:

$$P(f) = \sum_i^{\infty} a_i(f)\Psi_i$$

where $a_i(f)$ i=1, 2, . . . is a unique set of coefficients depending on frequency.

Modes or natural frequencies of an elastic structure, such as a loudspeaker diaphragm, describe standing waves, which depend on the geometry, the dimensions and the material of the structure. The present application focuses on flexural waves, which dominate the response for a thin elastic shell, like the loudspeaker diaphragm, in the frequency band of interest.

A modal analysis of the speaker diaphragm exhibits the vibration modeshapes $\Phi_i$ associated with the diaphragm resonant frequencies. When a voltage is applied to the loudspeaker pins, an electromagnetic force is generated in the voice coil. The resulting diaphragm displacement (or acceleration) vibration field vs. frequency is a linear sum of the diaphragm vibration modes:

$$W(f) = \sum_i^{\infty} b_i(f)\Phi_i$$

where $b_i(f)$ i=1, 2, . . . is a unique set of coefficients depending on frequency.

Both cavity acoustic modes and diaphragm modes have antinodes corresponding to maximum amplitude points and nodal lines corresponding to points having a zero amplitude.

Figure 2:
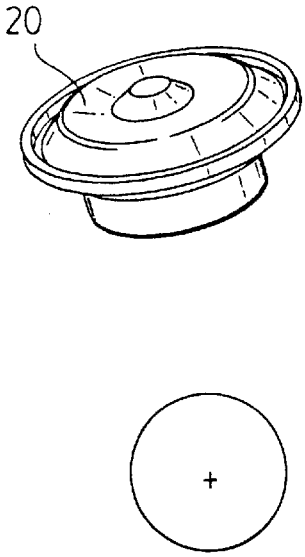
FIG. 2 is an isometric view of a finite element model of a loudspeaker diaphragm first mode at a frequency of 250 Hz.
Figure 3:
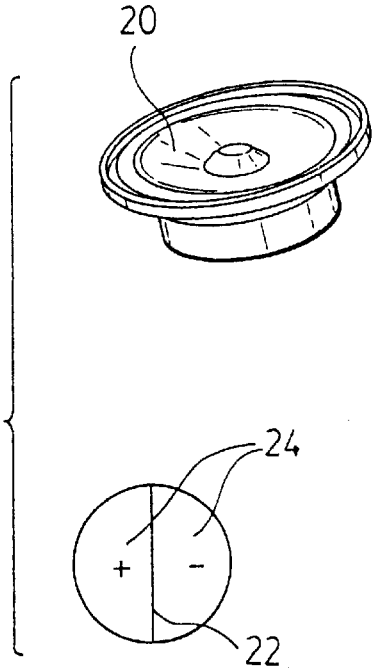
FIG. 3 is an isometric view of a finite element model of a loudspeaker diaphragm second mode at a frequency of 1000 Hz.

Because the diaphragm geometry, which includes the voice coil, is complex, Finite Element Analysis is used to exhibit the vibration modes and resonant frequencies. FIGS. 2 and 3 show the first and second loudspeaker diaphragm modes for a 64 mm loudspeaker diaphragm 20 at frequencies of 250 Hz and 1000 Hz respectively. The up-and-down movement of the diaphragm 20 of FIG. 2 is defined by an antinode at the centre and a nodal line around the perimeter. The see-saw movement of FIG. 3 is defined by nodal line 22 and antinodes 24.

When the speaker diaphragm 20 undergoes an electromagnetic force on its voice coil, its displacement (vibration) field at each frequency is a combination of diaphragm modes varying with frequency. Due to the direction of the electromagnetic force on the voice coil, the vibration field is dominated by the first diaphragm mode of FIG. 2, in a wide band of frequencies, but some other modes can contribute to the vibration. The same kind of phenomenon occurs in the enclosure. The pressure field induced by the diaphragm vibration in the enclosure varies with frequency and is a combination of the acoustic mode shapes. At some frequencies, the coupling of the diaphragm vibration field and the enclosure pressure field can be very strong. This coupling is strong when there is a "geometric" coincidence between the diaphragm vibration field and the enclosure pressure field i.e. antinodes of both fields are roughly at the same position. The coupling is reinforced if there is a frequency coincidence ie. the diaphragm and the enclosure are both close to a resonant frequency.

Depending on the general stiffness of the speaker diaphragm, its dimensions and position, resonant phenomena in the enclosure can partially "block" the diaphragm vibration in the case of strong coupling. As a result, the pressure field that is radiated by the loudspeaker towards the user, is strongly reduced because most of the radiated acoustic energy "remains" inside the enclosure. These phenomena result in notches in the acoustic frequency response curve measured at a listening position. The high amplitude variations that are induced are undesirable because sound quality reproduction generally requires a response, which is as flat as possible.

Although the telephone or speaker housing is an elastic structure coupled with some acoustics modes in the enclosure, the acoustic modes impact mainly the diaphragm vibration field in the conditions described above.

Figure 4:
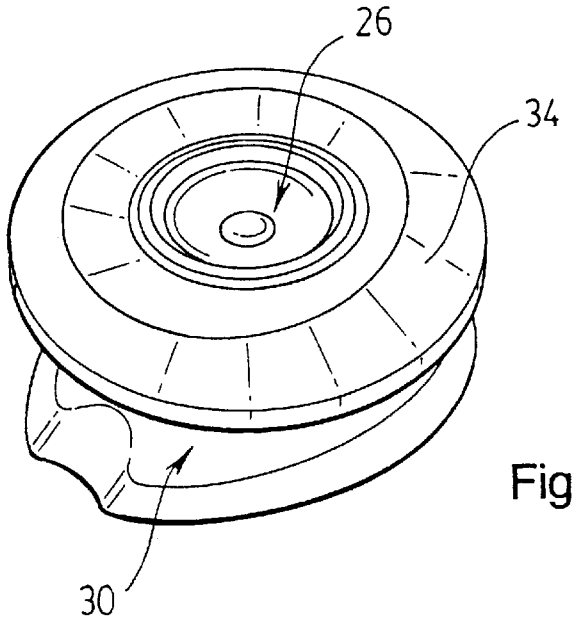
FIG. 4 is an isometric view of a finite element model of a telephone conference unit.

FIG. 4 shows a finite element model of a telephone conference unit, with a loudspeaker in the center. The telephone conference unit comprises a loudspeaker 26 that is surrounded by housing 34. The housing 34 is supported by a stand 30.

Figure 5:
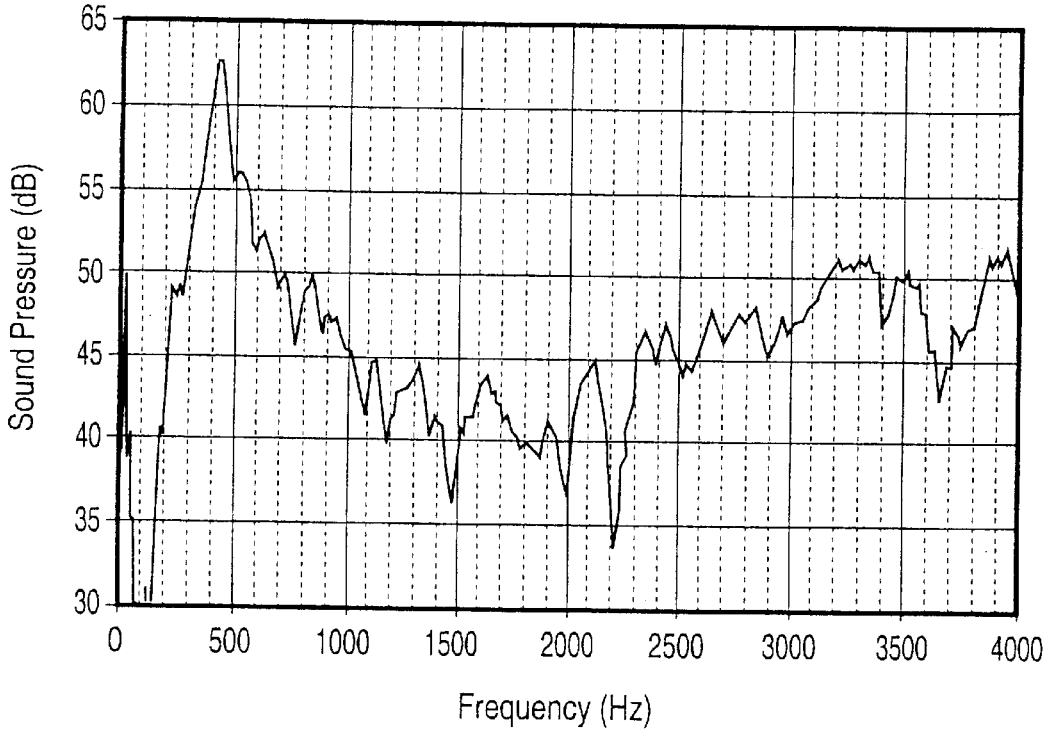
FIG. 5 is a graph showing receive response of a conference unit vs. frequency at an ear reference point that is 50 cm from the unit.

FIG. 5 is a graph that shows the sound pressure level at the listener ear reference point vs. frequency when the speaker undergoes a sweeping sine signal. After the first peak due to the first loudspeaker diaphragm resonance, many notches appear at 1.5, 2.0, 2.2, and 3.7 kHz. The notches occur close to enclosure acoustic resonance frequencies and result from the coupling of the diaphragm vibration field and the enclosure pressure field. It is desirable to suppress these notches to achieve a response that is as flat as possible.

Figure 6:
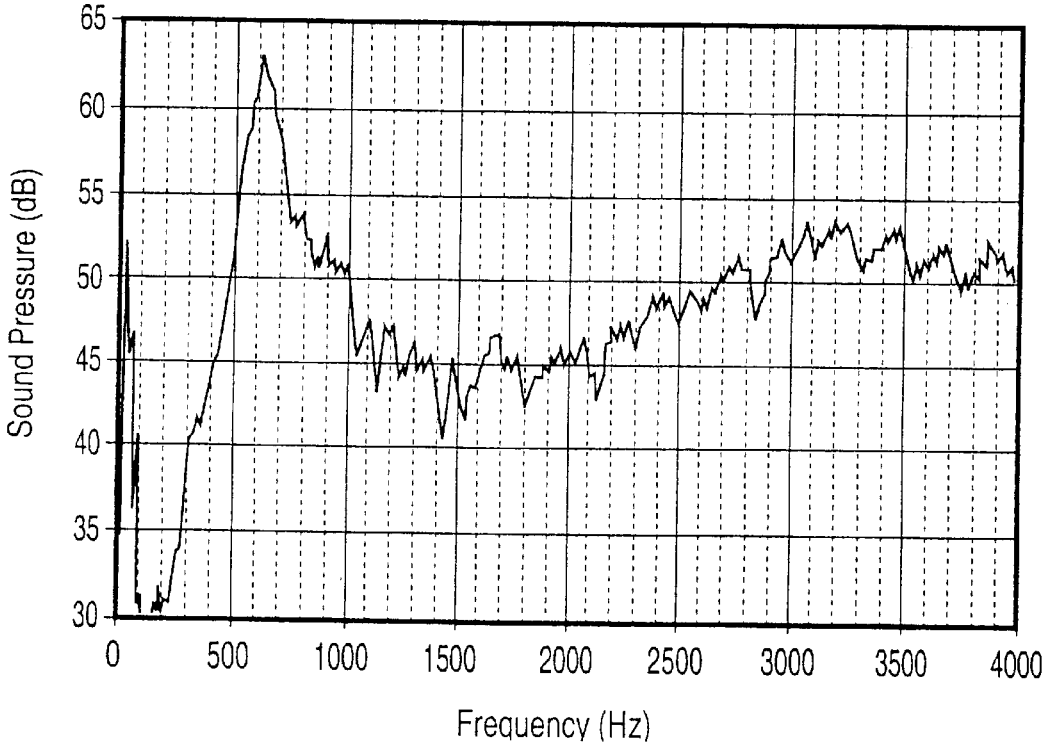
FIG. 6 is a graph showing sound pressure level of a conference unit vs. frequency at ear reference point for a closed 64 mm diameter cap.

FIG. 6 shows using a closed cap for isolating the diaphragm 20 from the unit enclosure 34, thereby suppressing the coupling diaphragm-acoustic modes. However, in some conditions, relating to diaphragm properties, the closed cap can cause the first resonance frequency of the loudspeaker to be shifted up, which is an unwanted effect.

Figure 7:
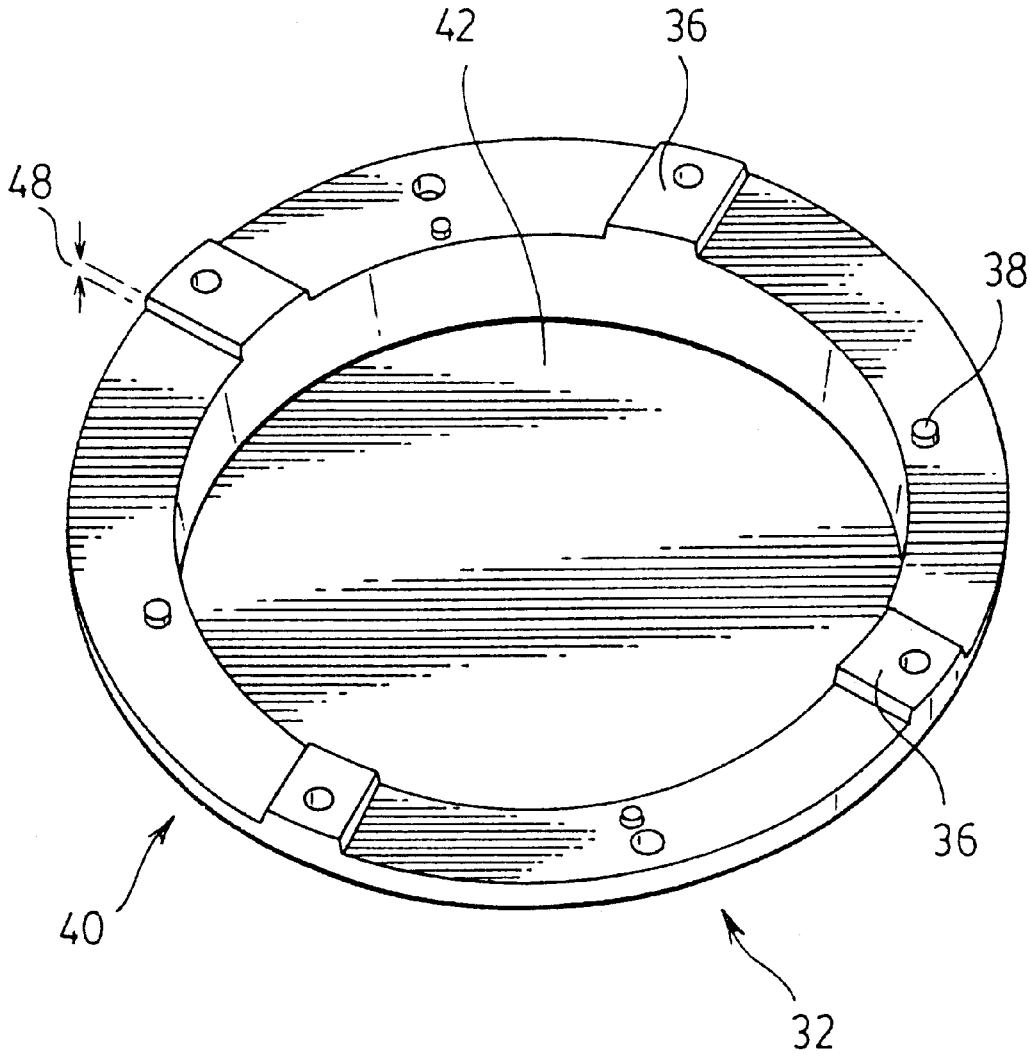
FIG. 7 is an isometric view of a loudspeaker cap of the present invention.
Figure 8:
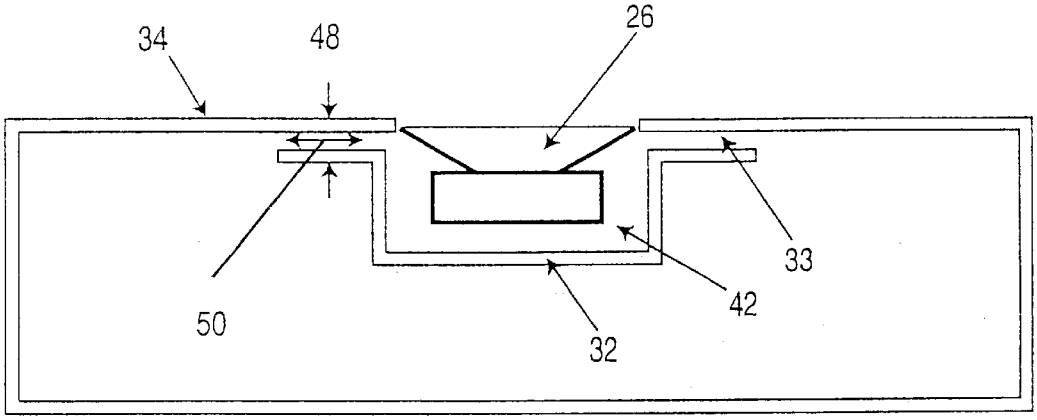
FIG. 8 is a schematic cross sectional view of a speaker housing with a cap having a slot.

Referring to FIGS. 7 and 8, a cap 32 is shown for installation into a telephone or speaker housing 34. A gap is provided between the cap 32 and the housing 34 to maintain or decrease the first resonance frequency of the loudspeaker without increasing significantly the coupling of the diaphragm vibration field and the enclosure pressure field. The cap 32 is provided with a slot 33, which allows for a gap between the housing 34 and the cap 32. Stands 36 and posts 38 are located on flange 40, which surrounds cap cavity 42. The stands 36 and posts 38 maintain a regular gap around the cap. Loudspeaker 26 is supported in cap cavity 42 and is directed outwardly from the housing 34. The cap 32 is screwed or glued to the telephone or speaker housing 34 when the housing 34 is flat.

Figure 9:
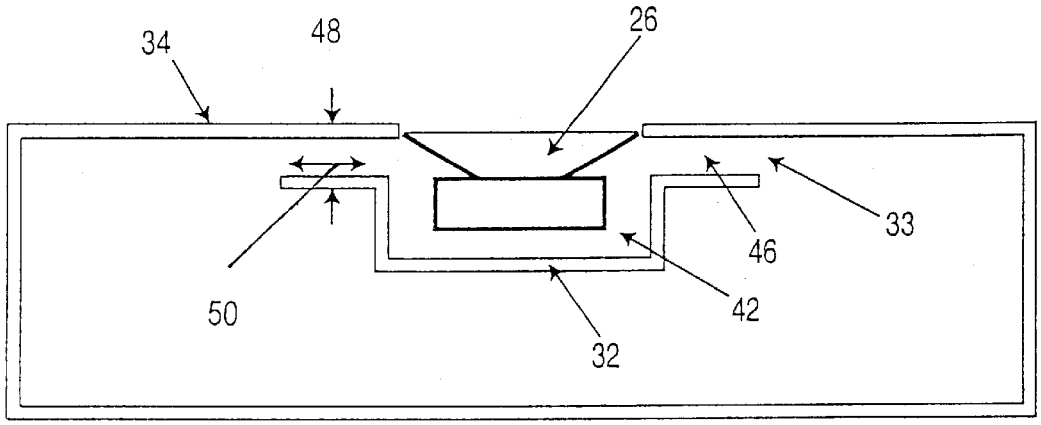
FIG. 9 is a schematic cross sectional view of a speaker housing with a cap having a slot that is filled with porous material.

Referring to FIG. 9, a second embodiment of a cap 32 is shown. The cap 32 has a large slot 33, which is filled with porous material 46. The types of porous material 46 that may be used include open cell foam, felt or any suitable material.

Figure 10:
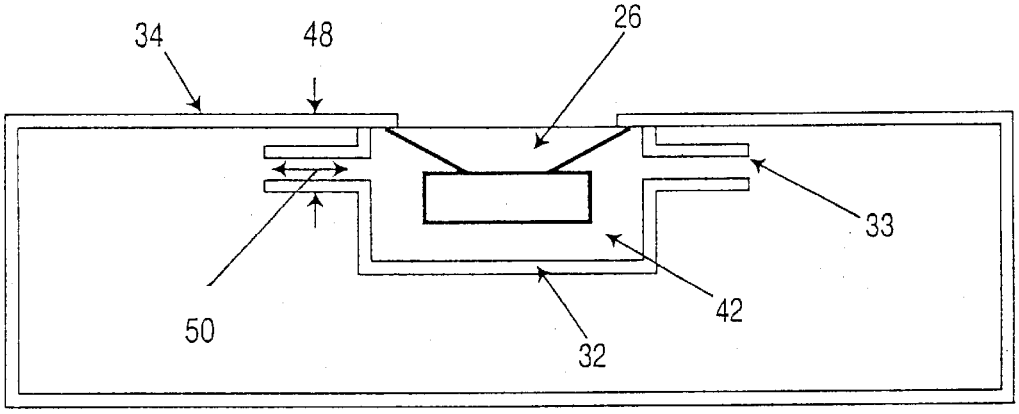
FIG. 10 is a schematic cross sectional view of a speaker housing with a cap having a slot and a loudspeaker ring.

Referring to FIG. 10, a further embodiment of a cap 32 is shown. The cap 32 is similar to the cap 32 of FIG. 8, however, a loudspeaker ring 44 is provided between the cap 32 and the housing 34. The loudspeaker ring 44 provides the cap 32 with a flat surface to connect to in the case where the housing 34 is not flat.

Although it is not necessary to construct the slot 33 with flat surfaces, flat surfaces allow for easier control of the slot height 48 and slot length 50 dimensions. The slot 33 of FIGS. 8 and 10 is thin which provides an acoustic resistance ("slow leak"). The slot 33 of FIG. 9 is large and filled with porous material 46.

The cap shape can be varied from that depicted in the Figures. The cap dimensions must be optimized through experiment or simulation, because the cap cavity volume and the slot dimensions strongly impact the loudspeaker acoustic response. The slot must remain thin to prevent significant coupling between the diaphragm and the enclosure acoustic modes.

In operation, the cap 32 isolates the loudspeaker diaphragm 20 from the enclosure acoustic modes. The slot 33 must be sufficiently thin, or the porous material 46 sufficiently dense, in order to prevent any strong coupling. The slot 33 induces a damping and an inertia effect. The damping effect occurs due to the viscosity of the air in the slot 33. When the speaker moves up and down, the pressure inside the cap cavity 42 increases and a flow of air occurs in the slot 33. Depending on the dimensions of the slot gap, friction takes place between the slot walls and the airflow thereby inducing damping. The air in the slot 33 constitutes an acoustic mass and tends to load the loudspeaker diaphragm 20, thereby shifting its first resonance frequency down. The leak dampens the first resonance amplitude.

The slot dimensions must be optimized experimentally or using simulations. The gap must be kept as small as possible to avoid any strong coupling between the cap cavity 42 and the speaker or telephone enclosure 34. If porous material is used in the gap, the gap can be made larger. The density of the porous material must be determined according to the slot length and height to optimize its damping effect and prevent a strong coupling between the diaphragm and the enclosure acoustic modes.

Figure 11:
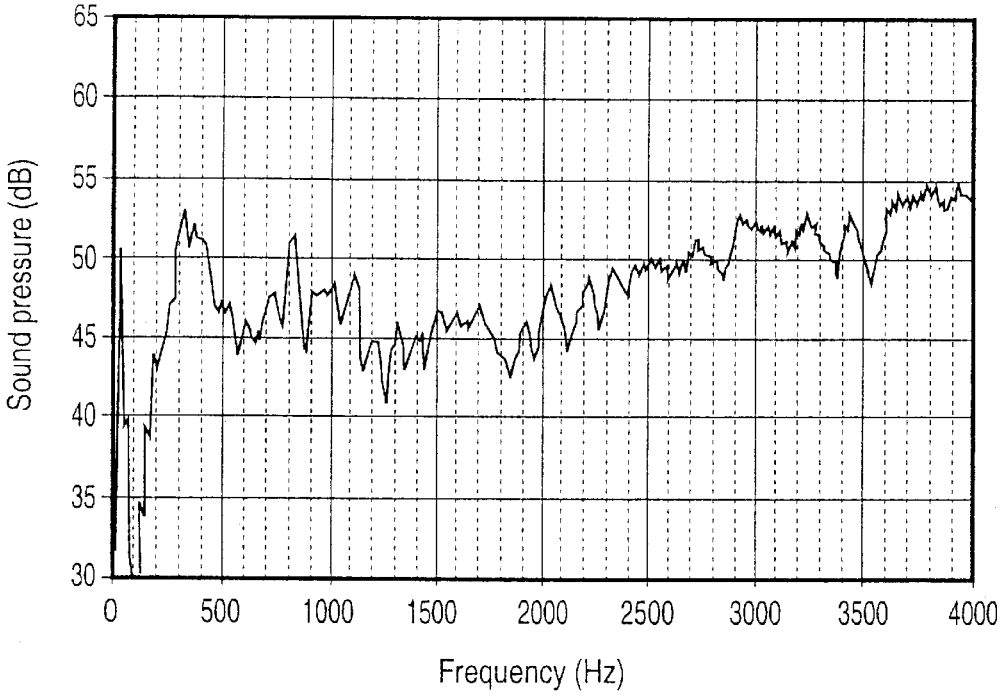
FIG. 11 is a graph showing sound pressure level of a conference unit vs. frequency at ear reference point for a 64 mm cap with a gap.

FIG. 11 shows the improving effect of a 64-mm cap with a slot 33 having a height dimension of 0.5 mm and a length dimension of 10 mm around the cap 32. The benefits of the invention can be seen clearly for the conference unit presented in FIG. 6. The result is a suppression of the notches due to the coupling diaphragm/enclosure acoustic resonances and a damping of the loudspeaker first resonance amplitude. The resulting sound response frequency curve is reasonably flat.

Acoustic resonances can occur in the cap 32 because it has an almost closed enclosure. Since the cap cavity 42 is smaller than the telephone or speaker housing 34, the first cap acoustic resonance is expected to occur at higher frequencies than for the telephone or speaker enclosure 34. When the speaker diaphragm 20 is strongly coupled with an acoustic resonance of the cap cavity 42, the diaphragm can be blocked.

Figure 12:
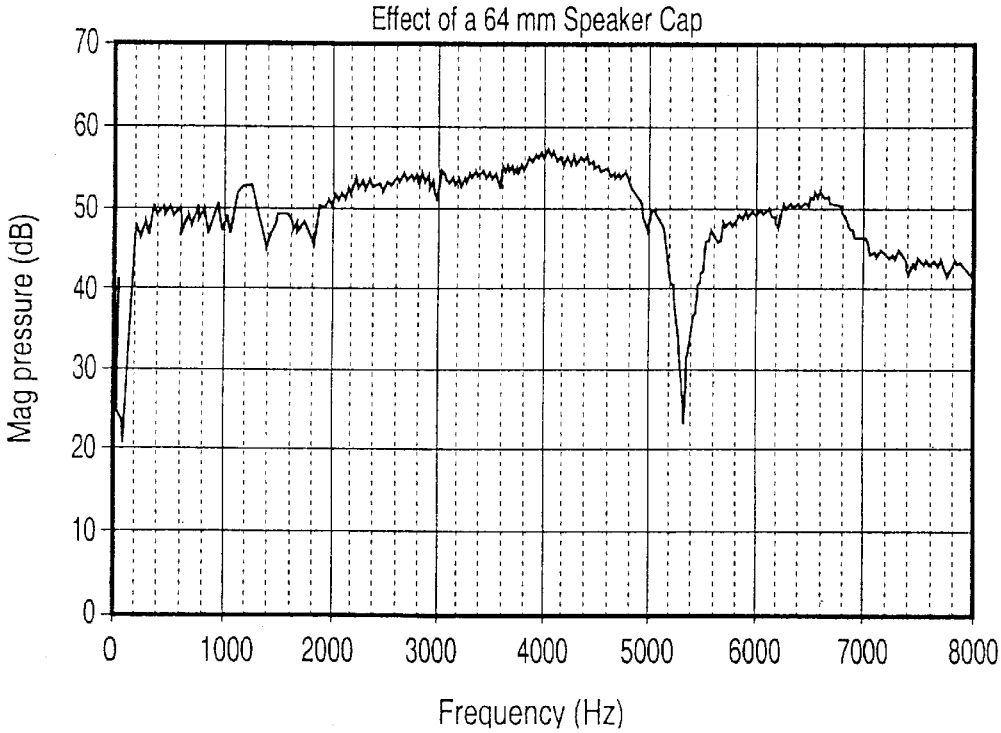
FIG. 12 is a graph showing the effect of a strong coupling between the diaphragm of a conference unit and an acoustic resonance in the 64 mm diameter cap at 5300 Hz.

FIG. 12 shows the receive frequency response of the conference unit of FIG. 4 at ear reference point, with a 64-mm diameter loudspeaker cap having a leak. A very strong amplitude notch appears at 5300 Hz due to the coupling of the diaphragm with an acoustic mode in the cap cavity. The frequency corresponds to a full acoustic wavelength equal to 64 mm in the cap. If the invention is to be applied in the frequency range of wideband telephony (150–7000 Hz) the cap diameter must be reduced to avoid this phenomenon, which induces the use of a smaller loudspeaker. The notch amplitude can also be reduced by the use of foam inside the cap cavity.

It is important that the dimensions of the acoustic cap be carefully adapted to the frequency range of each application. Additional applications for the acoustic cap include speakers, telephones and woofers. It is also important to note that the use of a slow leak around the cap may dampen and widen the frequency response but also decreases the sound pressure level (SPL) for the same electrical input. Therefore, it is necessary to find a compromise between the SPL drop and the benefit in terms of flat frequency response.

Although a preferred embodiment of the present invention has been described, those of skill in the art will appreciate that variations and modifications may be made without departing from the spirit and scope thereof as defined by the appended claims.

We claim:

1. A housing for an acoustical speaker having a movable diaphragm, said housing comprising:

an outer casing having an aperture and characterized by an acoustic resonance;

a cap having a flange located at an outer edge thereof, said flange comprising a series of protrusions for abutting said casing, said series of protrusions comprising an alternating pattern of posts and post-receiving stands, said flange being coupled to said outer casing so that said cap covers said aperture;

a cavity provided in said cap, said cavity being sized to house said acoustical speaker; and wherein a gap is provided between said flange of said cap and said outer casing delimited by said protrusions for dampening a first resonant frequency of said diaphragm, and maintaining said diaphragm de-coupled from said acoustic resonance in said outer casing.

2. A housing as claimed in claim 1 wherein said gap is filled with a porous material.

3. A housing as claimed in claim 2 wherein said porous material is open-cell foam.

4. A housing as claimed in claim 1 wherein said flange is of uniform thickness.

5. A housing as claimed in claim 4 wherein said flange of said cap comprises a series of protrusions having uniform height and being spaced from one another.

6. A housing as claimed in claim 5 wherein said outer casing has an opposing series of protrusions for mating with said series of protrusions located on said flange of said cap.

7. A cap for a housing for an acoustical speaker having a movable diaphragm, said cap comprising:

a flange located at an outer edge thereof;

a cavity provided in said cap, said cavity being sized to house said acoustical speaker;

a series of protrusions of uniform height and being spaced from one another, said protrusions comprising an alternating pattern of posts and post-receiving stands, said protrusions extending from said flange for coupling said cap to an outer casing of said housing so that said cap covers an aperture in said outer casing, said outer casing being characterized by an acoustic resonance; and wherein a gap is provided between said cap and said outer casing delimited by said protrusions for dampening a first resonant frequency of said diaphragm, and maintaining said diaphragm de-coupled from said acoustic resonance in said outer casing.

8. A housing for an acoustical speaker having a movable diaphragm, said housing comprising:

an outer casing having an aperture and characterized by an acoustic resonance;

a ring having an upper surface and a planar lower surface, said upper surface of said ring sized for coupling to a mating surface on said outer casing about said aperture;

a cap having a flange located at an outer edge thereof; said flange comprising a series of protrusions having uniform height and being spaced from one another for abutting said outer casing, said series of protrusions comprising an alternating pattern of posts and post-receiving stands said flange being coupled to said planar lower surface of said ring so that said cap covers said aperture;

a cavity provided in said cap, said cavity being sized to house said acoustical speaker; and wherein a gap is provided between said flange of said cap and said planar lower surface of said ring de-limited by said protrusions for dampening a first resonant frequency of said diaphragm, and maintaining said diaphragm de-coupled from said acoustic resonance in said outer casing.

9. The cap of claim 7 wherein said outer casing has an opposing series of protrusions and said series of protrusions extending from said flange meets with said opposing series of protrusions.

10. A housing for an acoustical speaker having a movable diaphragm, said housing comprising:

an outer casing having an aperture and characterized by an acoustic resonance, said outer casing having a series of protrusions with uniform height and being spaced from one another;

a cap having a flange uniform thickness located at an outer edge thereof, said flange comprising an opposing series of protrusions having uniform height and being spaced from one another for mating with said series of protrusions located on said outer casing, said flange being coupled to said outer casing so that said cap covers said aperture;

a cavity provided in said cap, said cavity being sized to house said acoustical speaker; and wherein a gap is provided between said flange of said cap and said outer casing for dampening a first resonant frequency of said diaphragm, and maintaining said diaphragm de-coupled from said acoustic resonance in said outer casing.

* * * * *

UNITED STATES PATENT AND TRADEMARK OFFICE

CERTIFICATE OF CORRECTION

PATENT NO. : 6,741,717 B2
DATED : May 25, 2004
INVENTOR(S) : Dedieu et al.

It is certified that error appears in the above-identified patent and that said Letters Patent is hereby corrected as shown below:

Title page,
Item [30], Foreign Application Priority Data, "Sep. 28, 2001 (GB) ……. 0123451" should read -- Sep. 28, 2001 (GB) ….. 0123451.7 --.

Column 7,
Line 18, "stands said flange" should read -- stands, said flange --.

Signed and Sealed this

Thirtieth Day of August, 2005

JON W. DUDAS
*Director of the United States Patent and Trademark Office*